US007307515B1

(12) United States Patent
Schake

(10) Patent No.: US 7,307,515 B1
(45) Date of Patent: Dec. 11, 2007

(54) TRAILER SECURITY SYSTEM USING MULTIPLE TRANSMITTER/RECEIVER PAIRS

(76) Inventor: Michael L. Schake, 20617 Cleary Rd. NW., Anoka, MN (US) 55303

( * ) Notice: Subject to any disclaimer, the term of this patent is extended or adjusted under 35 U.S.C. 154(b) by 170 days.

(21) Appl. No.: 11/158,567

(22) Filed: Jun. 22, 2005

(51) Int. Cl.
*G08B 21/00* (2006.01)

(52) U.S. Cl. ..... 340/431; 340/541; 116/75

(58) Field of Classification Search ..... 340/555–557, 340/541, 431, 583, 550, 552, 438, 425.5
See application file for complete search history.

(56) References Cited

U.S. PATENT DOCUMENTS 3,711,846 A * 1/1973 Schlisser et al. ..... 340/557
4,910,498 A * 3/1990 Feher ..... 340/556
6,822,566 B2 * 11/2004 Matthews et al. ..... 340/555

FOREIGN PATENT DOCUMENTS

GB 2174194 A * 10/1986

* cited by examiner

*Primary Examiner*—Jeffery Hofsass
*Assistant Examiner*—Sigmund Tang

(57) ABSTRACT

A trailer security system for a utility trailer is disclosed. The trailer security system includes a pair of side detection units and a middle detection unit provided between the side detection units which are placed in the utility trailer. Upon entry of an intruder into the utility trailer, at least one of the detection units is activated, thus scaring the intruder and alerting persons in the vicinity of the trailer to the presence of the intruder. A method of securing a utility trailer against intrusion is also disclosed.

18 Claims, 4 Drawing Sheets

TRAILER SECURITY SYSTEM USING MULTIPLE TRANSMITTER/RECEIVER PAIRS

FIELD OF THE INVENTION

The present invention relates to security systems. More particularly, the present invention relates to a trailer security system which alerts to the presence of an intruder breaking into a utility trailer.

BACKGROUND OF THE INVENTION

Utility trailers are commonly used by sportsmen to store and transport expensive sports equipment as well as by contractors, tradesmen and construction workers to store and transport tools, construction supplies and other items. Such utility trailers typically include a wheeled frame on which is mounted a housing having a housing interior for storage of the items and a door which can be locked to secure the items in the housing interior. However, utility trailers typically lack an alarm system for alerting persons to the presence of intruders breaking into the trailer.

Therefore, a trailer security system is needed for alerting persons to the presence of an intruder or intruders breaking into a utility trailer.

SUMMARY OF THE INVENTION

The present invention is generally directed to a trailer security system for a utility trailer. The trailer security system includes a pair of side detection units and a middle detection unit provided between the side detection units which are placed in the utility trailer. Upon entry of an intruder into the utility trailer, at least one of the detection units is activated, thus scaring the intruder and alerting persons in the vicinity of the trailer to the presence of the intruder. The invention is further directed to a method of securing a utility trailer against intrusion.

BRIEF DESCRIPTION OF THE DRAWINGS

The invention will now be described, by way of example, with reference to the accompanying drawings, in which.

DETAILED DESCRIPTION OF THE INVENTION

Figure 1:
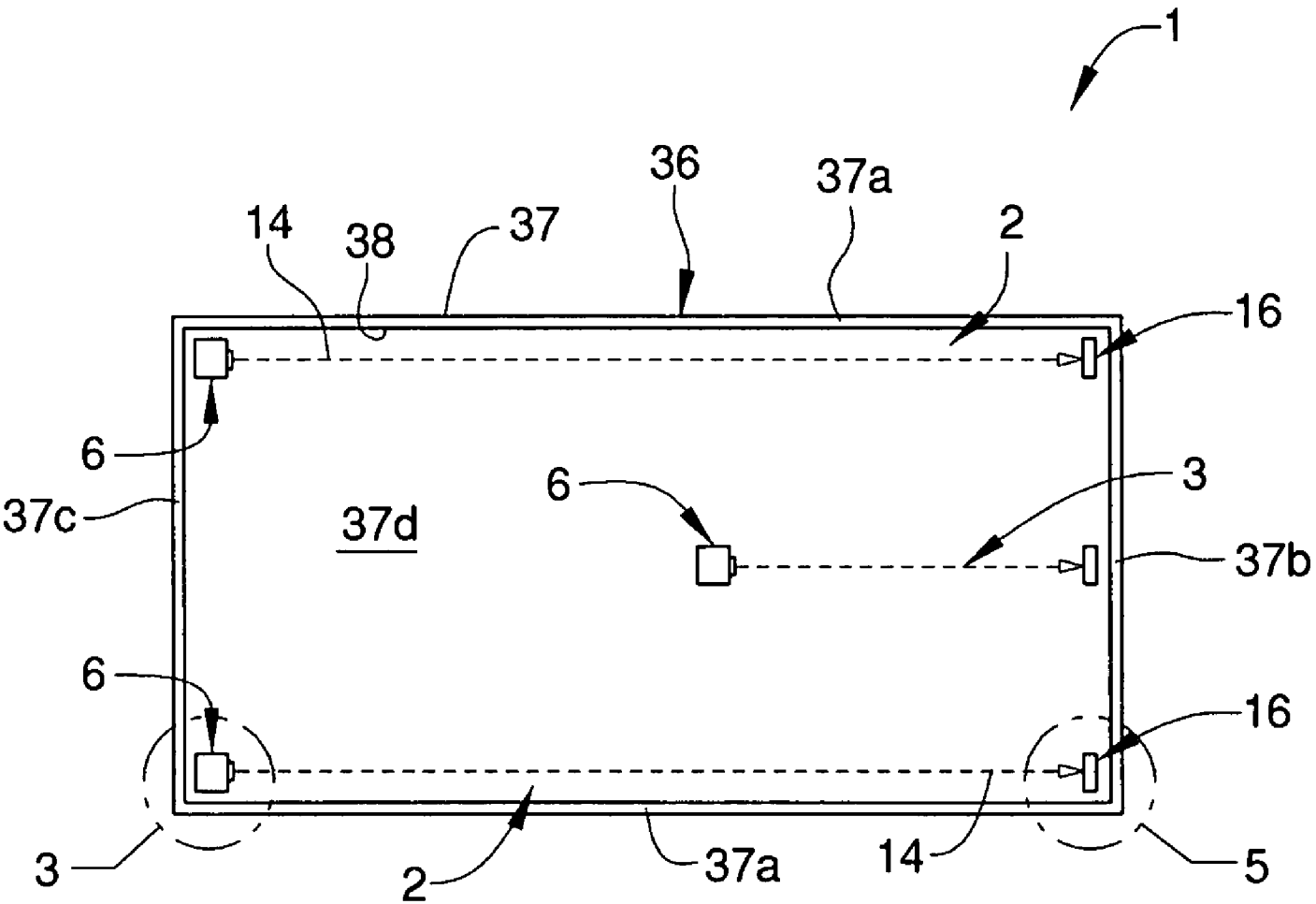
FIG. 1 is a top view of a trailer, with the trailer security system of the present invention mounted in the trailer.

Referring to the drawings, an illustrative embodiment of the trailer security system of the present invention is generally indicated by reference numeral 1 in FIG. 1. The trailer security system 1 is adapted for use in a utility trailer 36, which may be conventional and includes a trailer housing 37, typically mounted on a wheeled frame (not shown). The trailer housing 37 has a pair of side walls 37*a*, a front wall 37*b*, a rear wall 37*c*, a floor 37*d* and a ceiling (not shown) which is supported by the side walls 37*a*, front wall 37*b* and rear wall 37*c*. A housing interior 38 which is selectively closed by one or a pair of doors (not shown) that is provided on the trailer housing 37 and can be selectively locked, using a padlock (not shown) or other locking mechanism, typically in conventional fashion. As will be hereinafter further described, the trailer security system 1 is mounted in the housing interior 38 to sense the presence of intruders breaking into the trailer housing 37 and alert bystanders or other persons to the presence of the break-in.

The trailer security system 1 includes a pair of side detection units 2 which are provided in the housing interior 38, on respective sides of the trailer housing 37, and a middle detector unit 3 which is provided in the housing interior 38, in the middle of the trailer housing 37. Each of the side detector units 2 includes a transmitter 6 which is mounted on the rear wall 37*c* or corresponding side wall 37*a* of the trailer housing 37 and a receiver 16 which is mounted on the front wall 37*b* or corresponding side wall 37*a* of the trailer housing 37. The receiver 16 is positioned in receiving relationship with respect to light emitted from the corresponding transmitter 6 of each side detector unit 2, as will be hereinafter described. The middle detector unit 3 also includes a transmitter 6 which is typically attached to or suspended from the ceiling (not shown) of the trailer housing 37 and a receiver 16 which is typically attached to or suspended from the ceiling or attached to the front wall 37*b* of the trailer housing 37. The receiver 16 is positioned in receiving relationship with respect to light emitted from the transmitter 6 of the middle detector unit 3, as will be hereinafter described.

Figure 2:
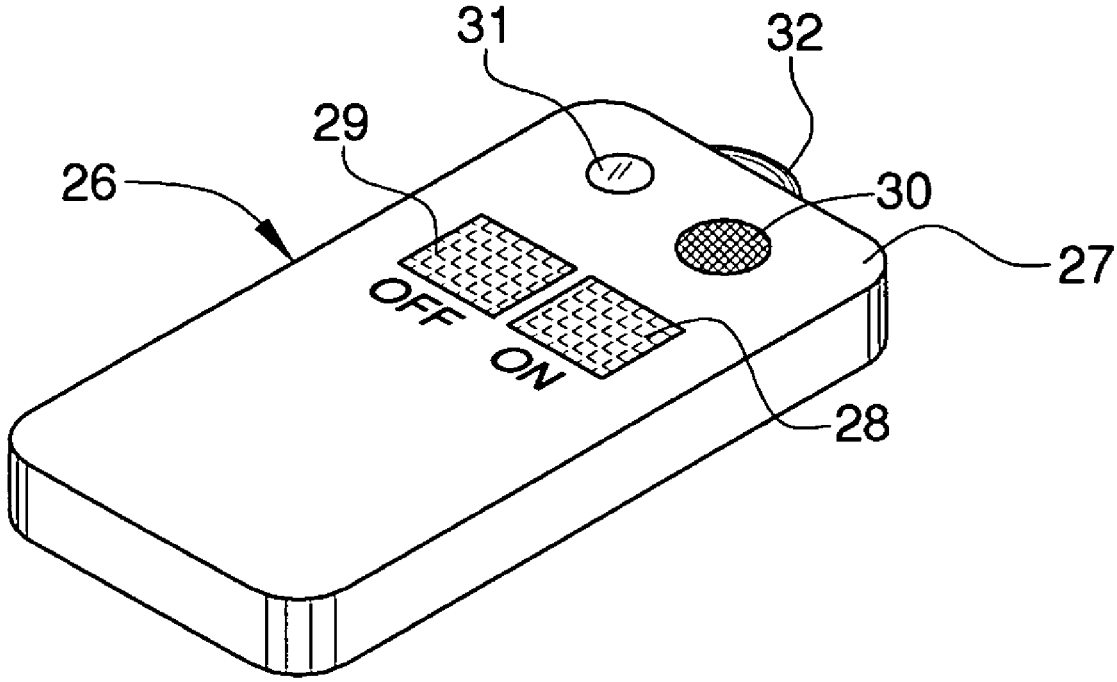
FIG. 2 is a perspective view of a remote control unit which is suitable for activating and inactivating the trailer security system.
Figure 3:
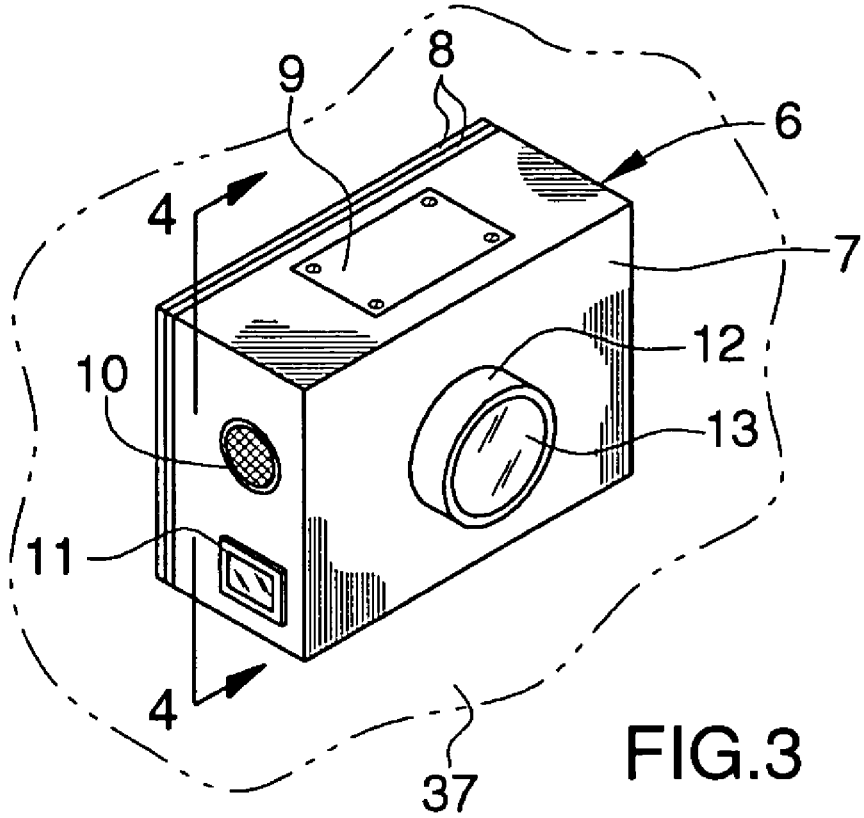
FIG. 3 is a front perspective view of a transmitter component of the trailer security system, taken along section line 3 in FIG. 1 and mounted on the trailer housing.
Figure 4:
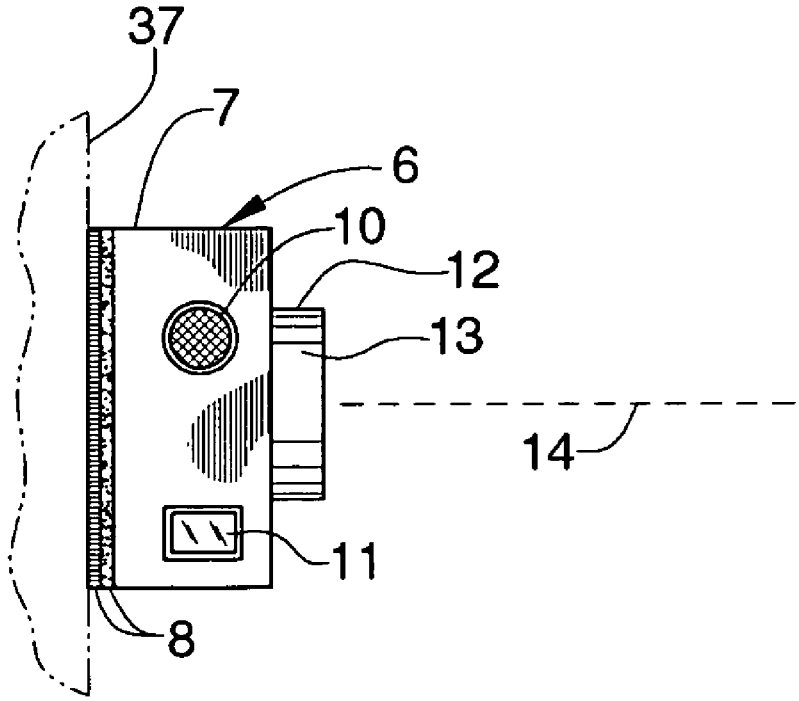
FIG. 4 is a side view of the transmitter, with a light beam being emitted from the transmitter.

As shown in FIGS. 3 and 4, the transmitter 6 of each side detector unit 2 and the middle detector unit 3 typically includes a transmitter housing 7 which is attached to the trailer housing 37 using hook-and-loop fastener strips 8, magnets (not shown), threaded fasteners (not shown) or other suitable technique known to those skilled in the art. A transmitter microprocessor (not shown) is provided in the transmitter housing 7. The transmitter microprocessor is connected to a battery (not shown) provided in a battery compartment 9 which is contained in the transmitter housing 7. An audible alarm 10 may be provided on the transmitter housing 7 and connected to the transmitter microprocessor. A receiver 11 may be provided on the transmitter housing 7 and connected to the transmitter microprocessor to facilitate activation of the transmitter 6 from an "off" mode to an "on" mode, and vice-versa, using a hand-held remote control device 26 (FIG. 2), as will be hereinafter described. Alternatively or additionally, a power switch (not shown) may be provided on the transmitter housing 7 and connected to the transmitter microprocessor to facilitate manual activation or inactivation of the transmitter 6. A lens housing 12, in which is mounted a translucent lens 13, is further provided on the transmitter housing 7. A light-emitting device (not shown) is provided in the transmitter housing 7 and connected to the transmitter microprocessor. The light-emitting device is suitably positioned to transmit light from the transmitter housing 7, through the lens 13 when the transmitter 6 is in the "on" mode. The transmitter microprocessor in the transmitter housing 7 includes the capability of being activated to the "on" mode by the remote control device 26 through the receiver 11 and energizing the light-emitting device (not shown) to emit a light beam 14 from the transmitter housing 7, through the lens 13, as shown in FIG. 4, as long as the transmitter 6 remains in the "on" mode.

Figure 5:
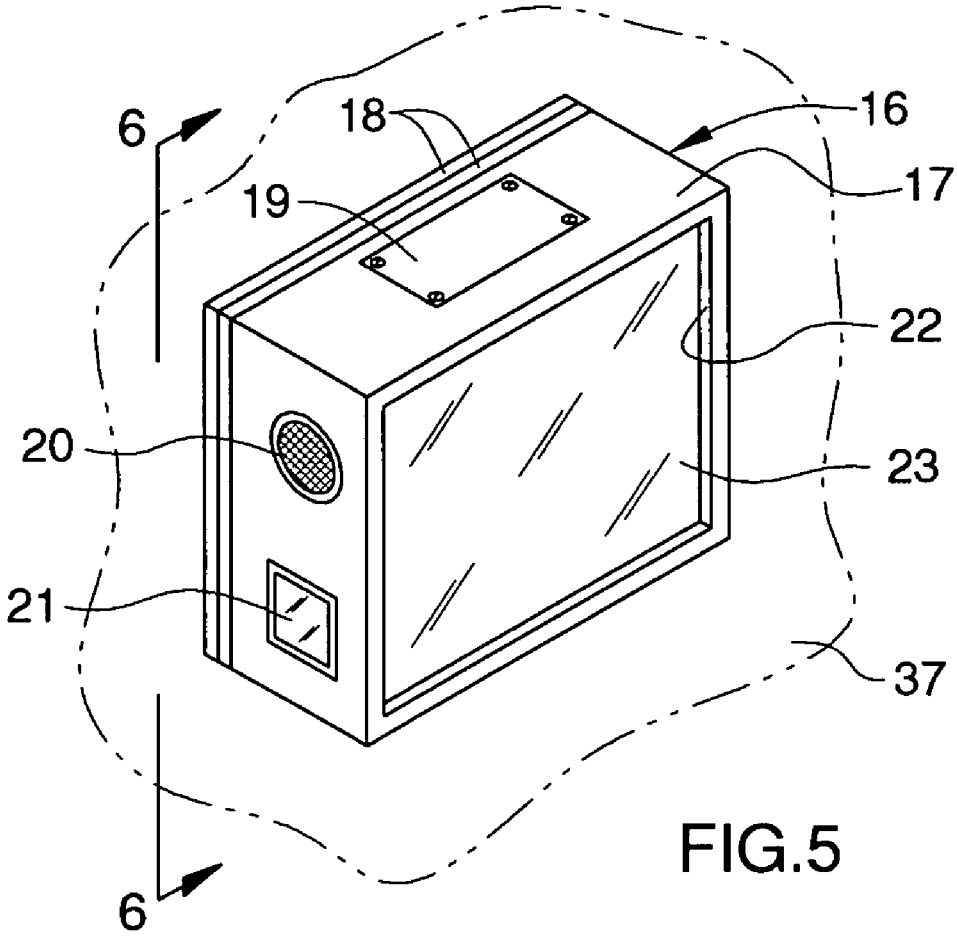
FIG. 5 is a front perspective view of a receiver component of the trailer security system, taken along section line 5 in FIG. 1.
Figure 6:
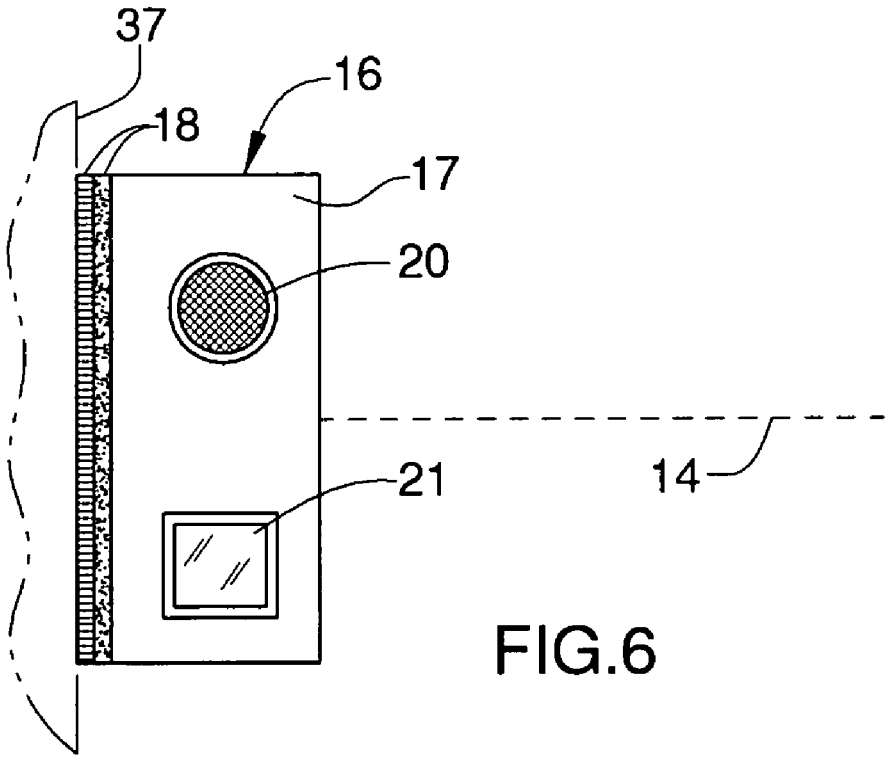
FIG. 6 is a side view of the receiver, with a light beam emitted by the transmitter being received by the receiver.

As shown in FIGS. 5 and 6, the receiver 16 of each side detector unit 2 and the middle detector unit 3 typically includes a receiver housing 17 which is attached to the trailer housing 37 using hook-and-loop fastener strips 18, magnets (not shown) or other suitable technique known to those skilled in the art. A receiver microprocessor (not shown) is provided in the receiver housing 17. The receiver microprocessor is connected to a battery (not shown) provided in a battery compartment 19 which is contained in the receiver housing 17. An audible alarm 20 may be provided on the transmitter housing 7 and connected to the receiver microprocessor. A receiver 21 may be provided on the receiver housing 17 and connected to the receiver microprocessor to facilitate activation of the receiver 16 to the "on" mode using the hand-held remote control device 26 (FIG. 2), as will be hereinafter described. A power switch (not shown) may be additionally or alternatively provided on the receiver housing 17 and connected to the receiver microprocessor to facilitate manual activation or inactivation of the receiver 16. A lens opening 22, in which is mounted a translucent lens 23, is further provided on the receiver housing 17. A light sensor (not shown) is provided in the receiver housing 17 and connected to the receiver microprocessor. The light sensor is suitably positioned to continually receive light from the transmitter 6 as long as the transmitter 6 remains in the "on" mode. The receiver microprocessor in the receiver housing 17 includes the capability of being activated by the remote control device 26 through the receiver 21 and energizing the light sensor (not shown) to receive the light beam 14 from the transmitter 6, as shown in FIG. 6. The receiver microprocessor further includes the capability of activating the alarm 20 in the event that the light sensor stops receiving the light beam 14 through the lens 23 at any time while the receiver 16 is in the "on" mode.

As shown in FIG. 2, the remote control device 26 typically includes a housing 27 which houses a remote control microprocessor (not shown). A battery compartment (not shown) is provided in the housing 27 and contains a battery (not shown) which is connected to the remote control processor. A transmitter 32 is provided on the housing 27 and is connected to the remote control microprocessor. An "on" button 28, an "off" button 29, an alarm 30 and a lighting device 31 are further provided on the housing 27, and each is connected to the remote control microprocessor. Accordingly, upon depression of the "on" button 28, the remote control microprocessor transmits a signal which is received by the receiver 11 of the transmitter 6 (FIG. 3) and the receiver 21 of the receiver 16 (FIG. 5) of both of the side detector units 2 and the middle detector unit 3 to activate each transmitter 6 and receiver 21. The lighting device 31 is illuminated to indicate the "on" status of the trailer security system 1. Upon depression of the "off" button 29, the remote control microprocessor transmits a signal which is received by the receiver 11 of the transmitter 6 and the receiver 21 of the receiver 16 of the side detector units 2 and the middle detector unit 3 to inactivate each transmitter 6 and receiver 21.

As shown in FIG. 1, in typical use of the trailer security system 1, the transmitter 6 and receiver 16 of each side detector unit 2 and the middle detector unit 3 is activated typically by depression of the "on" button 28 which is provided on the remote control device 26. Accordingly, the transmitter 32 (FIG. 2) on the remote control device 26 transmits a signal to the receiver 11 of each transmitter 6 and the receiver 21 of each receiver 16. Therefore, each transmitter 6 emits a light beam 14 which is received by the receiver 16 of each side detector unit 2 and middle detector unit 3. As long as the receiver 16 receives the light beam 14 from the corresponding transmitter 6, the alarm 20 of each receiver 16 remains in an inactivated state. Accordingly, as shown in FIG. 1, each side and the middle front area of the housing interior 38 is constantly monitored for the presence of an intruder.

In the event that an intruder (not shown) breaks into the utility trailer 36, the intruder interrupts the light beam 14 which is emitted by a transmitter 6 and received by the corresponding receiver 16 of one of the side detector units 2 or the middle detector unit 3. Accordingly, the light sensor (not shown) provided in the receiver 16 transmits a signal to the receiver microprocessor (not shown) provided in the receiver 16. In turn, the receiver microprocessor activates the audible alarm 20, which emits an alarm sound. Therefore, the emitted sound attracts attention to the utility trailer 36 and scares off the intruder or intruders as well as alerts persons in the vicinity of the utility trailer 36 to the presence of an intruder or intruders breaking into the utility trailer 36.

While the preferred embodiments of the invention have been described above, it will be recognized and understood that various modifications can be made in the invention and the appended claims are intended to cover all such modifications which may fall within the spirit and scope of the invention.

What is claimed is:

1. A trailer security system for a utility trailer, comprising:

a pair of side detection units for placement in the utility trailer;

a middle detection unit provided between said pair of side detection units for placement in the utility trailer;

said pair of side detection units and said middle detection unit each comprises a transmitter for transmitting a light beam and a receiver provided in spaced-apart relationship to said transmitter for receiving said light beam; and said receiver comprises a receiver housing and an alarm carried by said receiver housing and wherein said alarm is adapted for activation responsive to interruption of said light beam between said transmitter and said receiver.

2. The trailer security system of claim 1 further comprising a lens opening provided in said receiver housing and a lens provided in said lens opening.

3. The trailer security system of claim 1 wherein said transmitter comprises a transmitter housing, a lens housing carried by said transmitter housing and a lens provided in said lens housing.

4. The trailer security system of claim 1 wherein said receiver comprises a receiver housing and an alarm carried by said receiver housing and wherein said alarm is adapted for activation responsive to interruption of said light beam between said transmitter and said receiver, and wherein said transmitter comprises a transmitter housing, a lens housing carried by said transmitter housing and a lens provided in said lens housing.

5. The trailer security system of claim 4 further comprising an attachment mechanism carried by said receiver housing and said transmitter housing for attaching said receiver housing and said transmitter housing to the utility trailer.

6. The trailer security system of claim 5 wherein said attachment mechanism comprises hook-and-loop fasteners.

7. A trailer security system for a utility trailer, comprising:

a pair of side detection units for placement in the utility trailer;

a middle detection unit provided between said pair of side detection units for placement in the utility trailer; and a remote control device for selectively activating said pair of side detection units and said middle detection unit.

8. The trailer security system of claim 7 wherein each of said pair of side detection units and said middle detection unit each comprises a transmitter for transmitting a light beam and a receiver provided in spaced-apart relationship to said transmitter for receiving said light beam.

9. The trailer security system of claim 8 wherein said receiver comprises a receiver housing and an alarm carried by said receiver housing and wherein said alarm is adapted for activation responsive to interruption of said light beam between said transmitter and said receiver, and wherein said transmitter comprises a transmitter housing, a lens housing carried by said transmitter housing and a lens provided in said lens housing.

10. The trailer security system of claim 9 further comprising an attachment mechanism carried by said receiver housing and said transmitter housing for attaching said receiver housing and said transmitter housing to the utility trailer.

11. The trailer security system of claim 10 wherein said attachment mechanism comprises hook-and-loop fasteners.

12. The trailer security system of claim 7 wherein said remote control device comprises a housing and a transmitter carried by said housing for transmitting signals to said pair of side detection units and said middle detection unit.

13. A method of securing a utility trailer having a trailer interior against intrusion, comprising:

providing a pair of side detection units in said trailer interior on respective sides of said utility trailer;

providing a middle detection unit having an alarm in said trailer interior between said pair of side detection units, each of said pair of side detection units and said middle detection unit having a transmitter and a receiver having an alarm spaced-apart from said transmitter;

emitting a light beam from said transmitter to said receiver; and activating said alarm when said light beam is interrupted.

14. The method of claim 13 wherein said receiver comprises a receiver housing having a lens opening and a lens provided in said lens opening and wherein said transmitter comprises a transmitter housing, a lens housing carried by said transmitter housing and a lens provided in said lens housing.

15. The method of claim 14 further comprising an attachment mechanism carried by said receiver housing and said transmitter housing for attaching said receiver housing and said transmitter housing to the utility trailer.

16. The method of claim 15 wherein said attachment mechanism comprises hook-and-loop fasteners.

17. The method of claim 13 further comprising providing a remote control device and activating and deactivating said pair of side detection units and said middle detection unit by operation of said remote control device.

18. The method of claim 17 wherein said remote control device comprises a housing and a transmitter carried by said housing for transmitting signals to said pair of side detection units and said middle detection unit.

* * * * *